US005118600A

United States Patent [19]

Yamada et al.

[11] Patent Number: 5,118,600

[45] Date of Patent: Jun. 2, 1992

[54] SILVER HALIDE PHOTOGRAPHIC EMULSION

[75] Inventors: Sumito Yamada; Mikizou Kuwabara, both of Kangawa, Japan

[73] Assignee: Fuji Photo Film Co., Ltd., Kanagawa, Japan

[21] Appl. No.: 714,370

[22] Filed: Jun. 12, 1991

Related U.S. Application Data

[63] Continuation of Ser. No. 403,237, Sep. 5, 1989, abandoned.

[30] Foreign Application Priority Data

Sep. 5, 1988 [JP] Japan ..... 63-221787

[51] Int. Cl.[5] ..... G03C 1/035; G03C 1/10

[52] U.S. Cl. ..... 430/567; 430/569; 430/570

[58] Field of Search ..... 430/567, 569

[56] References Cited

U.S. PATENT DOCUMENTS

| | | | |
|---|---|---|---|
| 3,628,960 | 12/1971 | Philippaerts et al. | 430/571 |
| 4,225,666 | 9/1980 | Locker et al. | 430/569 |
| 4,434,226 | 2/1984 | Wilgus et al. | 430/567 |
| 4,542,094 | 9/1985 | Koshizuka et al. | 430/569 |
| 4,610,958 | 9/1986 | Matsuzaka et al. | 430/567 |
| 4,791,053 | 12/1988 | Ogawa | 430/581 |

*Primary Examiner*—Richard L. Schilling
*Assistant Examiner*—Janet C. Baxter
*Attorney, Agent, or Firm*—Sughrue, Mion, Zinn, Macpeak & Seas

[57] ABSTRACT

A chemically sensitized silver halide photographic emulsion comprising silver halide grains, at least 70% of the projected surface area of all the silver halide grains being constituted by tabular grains having an aspect ration of at least 3, wherein at least 0.5 millimoles of a sensitizing dye and 0.5 to 5.0 millimoles of at least one silver halide adsorbing substance other than a sensitizing dye per mole of the silver halide are introduced in the emulsion preparation stage and are present during chemical sensization of the silver halide.

3 Claims, No Drawings

SILVER HALIDE PHOTOGRAPHIC EMULSION

This is a continuation of application Ser. No. 07/403,237 filed Sep. 5, 1989.

FIELD OF THE INVENTION

This invention relates to a silver halide photographic emulsion, and in particular relates to a technique for markedly improving the developability, sensitivity/fogging ratio and pressure characteristics of tabular silver halide grains having an aspect ratio of at least 3.

BACKGROUND OF THE INVENTION

In recent years, the processing time for the development of photographic photosensitive materials (referred to as "photosensitive materials" below) has been greatly shortened by advances in high-temperature rapid processing and in the automatic development processing of various photosensitive materials. To achieve rapid processing, developing solutions which produce satisfactory image density in a short time, and photosensitive materials with excellent developability and which provide adequate black densities and dry within a short time after washing are desired. A method which is effectively used to improve the drying properties of photosensitive materials comprises adding an appropriate amount of a film hardener (gelatin crosslinking agent) during the photosensitive material coating stage. The film hardener decreases the amount of water contained in the material prior to the start of drying by reducing the amount of swelling of the emulsion layer(s) and surface protective layer during the development, fixing and washing stages. Although the drying time is shortened in proportion to the amount of film hardener used, development is delayed, a lowering in sensitivity and soft gradation occur, and the covering power is diminished by the reduction in the amount of swelling. Furthermore, when carrying out high-temperature rapid processing using processing agents wherein the developing solution and fixing solution substantially have no gelatin hardening effect, as disclosed in JP-A-63-144084 (the term "JP-A" as used herein means an "unexamined published Japanese patent application"), it is essential to adequately harden the photosensitive material prior to processing, and, with silver halide emulsions having slow developability, it is not possible to effect processing in a short time. On the other hand, methods for increasing the development activity of the processing solutions are also known, namely the amounts of the developing agents and auxiliary development agents in the developing solution may be increased, the pH of the developing solution may be increased, or the processing temperature may be raised. However, with each of these methods, there are disadvantages such as a loss in the preservative properties of the processing solutions, or susceptibility to fog and soft gradation may occur, even if the sensitivity is increased.

Aside from considerations of rapid processing, further increases in sensitivity and improvements in the graininess of the photosensitive materials is desired.

If increased sensitivity is brought about by an increase of the grain size, then there is a deterioration in graininess.

Thus, there is little gain if higher sensitivities are not achieved at the same grain size (for tabular grains, the same grain size being the same projected surface area diameter and the same thickness) or if graininess is not improved at the same sensitivity.

The object of the present invention is to provide a silver halide photographic emulsion having a high covering power and which exhibits markedly superior developability, sensitivity/fogging ratios and graininess using tabular-grained emulsions without increasing the projected surface area diameter or thicknesses.

Techniques using tabular grains to improve factors as described above have been disclosed in U.S. Pat. Nos. 4,439,520, 4,425,425 and 4,414,304, but the present invention differs by providing a performance which clearly excels the effects of the abovementioned patents and it relates to a technique for optimally exploiting the performance of tabular grains.

Furthermore, a technique for controlling the development starting point by deploying silver halide on specific surface portions (for example, an apex) of the tabular grains (so-called epitaxial growth) has been disclosed in JP-A-58-108526, but such a technique is undesirable from the standpoint of its applicability to production, such emulsions having poor aging stability in solution or in storage. The present invention also improves these aspects.

Moreover, it is known, as disclosed in U.S. Pat. Nos. 3,628,969 and 4,225,666, that it is possible to carry out simultaneous spectral sensitization and chemical sensitization by adding sensitizing dyes at the same time as the chemical sensitizers or, disclosed in JP-A-58-113928, to carry out spectral sensitization prior to chemical sensitization, or to initiate spectral sensitization by addition of the spectral sensitizing agents before the completion of silver halide grain precipitation production. In addition, it is known in the art to add a portion of the spectral sensitizing compounds prior to chemical sensitization and the remaining portion thereof after chemical sensitization as taught in U.S. Pat. No. 4,225,666, and that the addition may be made at any time during silver halide grain formation, notably using the method taught in U.S. Pat. No. 4,183,756.

However, with these known techniques, the abovedescribed silver halide crystal production methods differ from that of the present invention with respect to, for example, the amount of the sensitizing dyes and the grain formation method employed, and the effects of these known production methods clearly do not extend as far as the effects obtained by the method of the present invention.

Japanese Patent Application No. 62-141112 and U.S. patent application Ser. No. 07/202,852 (filed Jun. 6, 1988) disclose a technique for preparing high-sensitivity silver halide emulsions having good developability by ensuring that development commences from the apexes of each grains during the development processing, by the introduction of sensitizing dyes or silver halide adsorbing substances during the chemical sensitization. However, said technique has the following disadvantages: if large amounts of sensitizing dyes are introduced during chemical sensitization, the blackening phenomenon deteriorates markedly when outside pressure is applied to the silver halide grains; and when the photosensitive material is bent or rubbed, fogging and abrasion occur due to this pressure. The present invention eliminates these defects of the references.

Again, practical usage difficulties are encountered when silver halide adsorbing substances other than sensitizing dyes are introduced during chemical sensitization. This brings about an inhibition of sensitizing dye adsorption when color sensitization is then attempted. Residual color then remains after development processing of the photosensitive materials when dyes with a strong adsorbing power with respect to the silver halides have been used.

The present invention solves the above-noted problems and provides a high-sensitivity silver halide photographic emulsion having outstanding developability and with little pressure blackening.

SUMMARY OF THE INVENTION

The above object of the present invention is achieved by introducing, per mole of silver halide at least 0.5 millimoles of a sensitizing dye and from 0.5 to 5.0 millimoles of at least one silver halide adsorbing substance other than a sensitizing dye in the emulsion preparation stage and are present during the chemical sensitization, wherein the silver halide photographic emulsion comprises silver halide grains, at least 70% of the projected surface area of all the silver halide grains being tabular grains having an aspect ratio of at least 3.

DETAILED DESCRIPTION OF THE INVENTION

In the present invention the tabular grains preferably have an aspect ratio of from 3 to less than 20, and particularly from 4 to less than 8. As used herein, the aspect ratio is the ratio of the grain diameter to grain thickness, the grain diameter being represented by the diameter of a circle having the same surface area as the projected surface area of the silver halide grain.

To utilize the present invention effectively, for every mole of silver halide, at least 0.5 millimoles of a sensitizing dye and from 0.5 to 5.0 millimoles of a silver halide adsorbing substance other than a sensitizing dye are introduced in the emulsion preparation stage and are present during the chemical sensitization of the silver halide. The sensitizing dye and silver halide adsorbing substance other than a sensitizing dye may be added during grain formation, immediately after grain formation, or prior to or during ripening.

The sensitizing dye and silver halide adsorbing substance may be added separately, but it is preferable that they be added before the addition of chemical sensitizers (for example, gold or sulfur sensitizers) or at the same time as the chemical sensitizers, and must be present, at the latest, by the stage during which chemical sensitization is underway.

The silver halide adsorbing substance is added at a temperature of from 30° to 80° C., but a range of from 50° to 80° C. is preferred in order to reinforce the adsorbency thereof. The pH and pAg of the grain forming solution preferably has a pH of from 6 to 9 and a pAg of from 7 to 9, and particularly preferably a pAg of from 7.6 to 8.4 during chemical sensitization.

Silver halide adsorbing substances other than sensitizing dyes as referred to herein means photographic performance stabilizers.

The silver halide adsorbing substance of the present invention includes compounds known as antifoggants or stabilizers such as azoles (for example, benzothiazolium salts, benzimidazolium salts, imidazoles, benzimidazoles, nitroindazoles, triazoles, benzotriazoles, tetrazoles and triazines); mercapto compounds (for example, mercaptothiazoles, mercaptobenzothiazoles, mercaptoimidazoles, mercaptobenzimidazoles, mercaptobenzoxazoles, mercaptothiadiazoles, mercaptooxadiazoles, mercaptotetrazoles, mercaptotriazoles, mercaptopyrimidines and mercaptotriazines); thioketo compounds (for example, oxazolinethione); azaindenes (for example triazaindenes, tetraazaindenes, and in particular, 4-hydroxy substituted (1,3,3a,7)-tetraazaindene, and pentaazaindene).

Furthermore, silver halide adsorbing substances for use in the present invention include the polymeric compounds disclosed, for example, in JP-B-61-36213 (the term "JP-B" as used herein means an "examined Japanese patent publication") and JP-A-59-90844, and purines or nucleic acids.

Of these, azaindenes, purines and nucleic acids are preferably used in the present invention. The addition amount of the silver halide adsorbing substance of the present invention is from 0.5 to 5.0 millimoles, and preferably from 0.5 to 3.0 millimoles per mole of the silver halide.

Specific nonlimiting examples of useful silver halide adsorbing substances of the present invention are shown below.

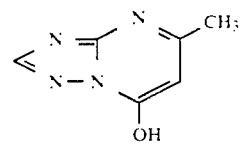

I-1

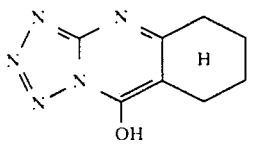

I-2

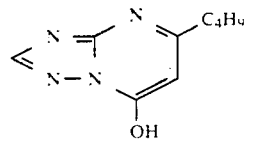

I-3

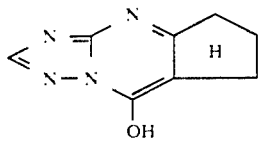

I-4

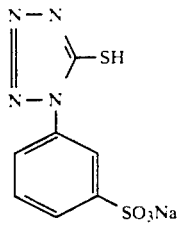

I-5

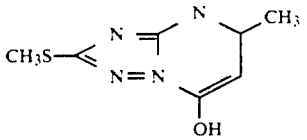

I-6

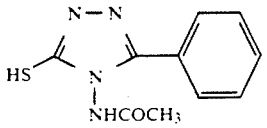

I-7

-continued
I-8
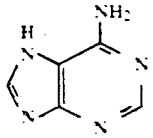
I-9
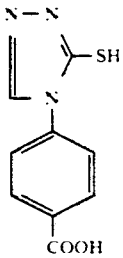
RNA I-10
DNA I-11
I-12
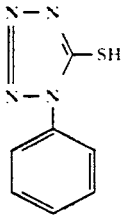
I-13
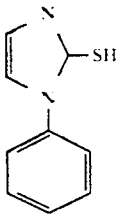
I-14
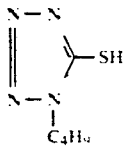
I-15
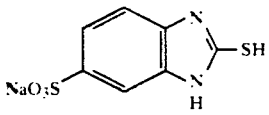
I-16
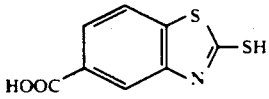
I-17
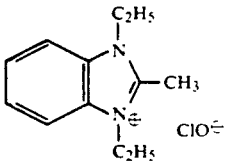
I-18
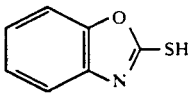
-continued
I-19
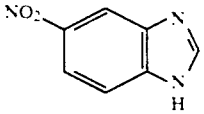
I-20
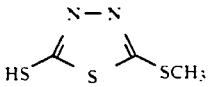
I-21
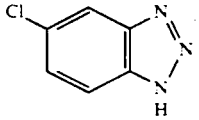
I-22
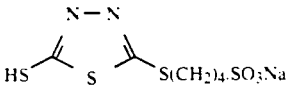
I-23
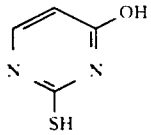
I-24
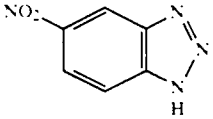
I-25
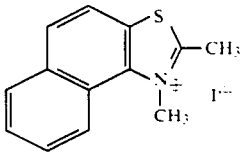
I-26
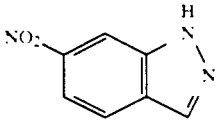
I-27
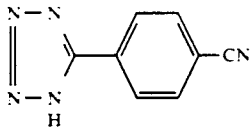
I-28
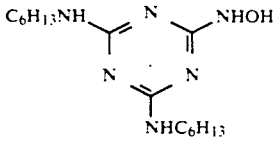
I-29
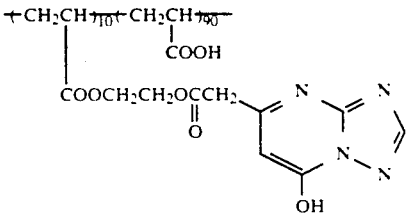

-continued

I-30

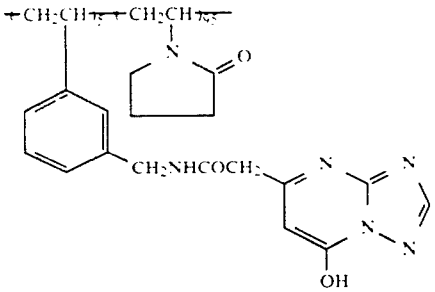

The effects of the present invention are obtained by the conjoint use of the sensitizing dyes and photographic performance stabilizers of the present invention during chemical sensitization.

Sensitizing dyes for use in the present invention include, for example, cyanine dyes, merocyanine dyes, complex cyanine dyes, complex merocyanine dyes, holopolar cyanine dyes, styryl dyes, hemicyanine dyes, oxonol dyes and hemioxonol dyes.

Effective sensitizing dyes for use in the present invention are disclosed, for example, in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632 and 2,503,776, JP-A-48-76525 and Belgian Patent 691,807. The addition amount of the sensitizing dye is from 0.5 millmoles to 4 millmoles and preferably from 0.5 millmoles to 1.5 millmoles per mole of the silver halide.

Nonlimiting specific examples of useful sensitizing dyes of the present invention are shown below.

II-1

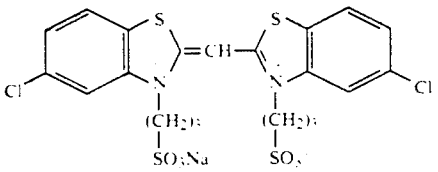

II-2

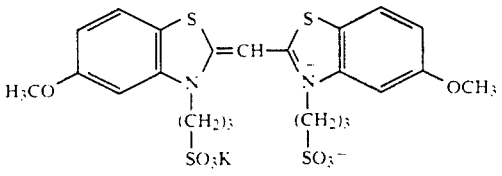

II-3

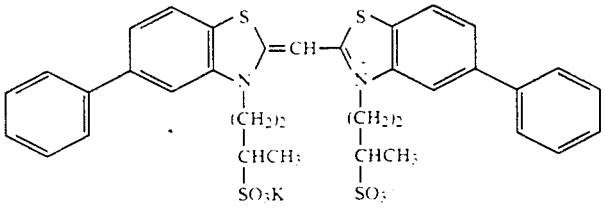

II-4

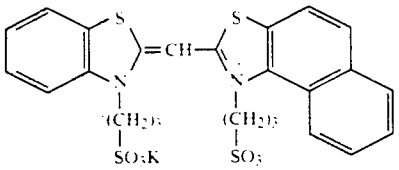

II-5

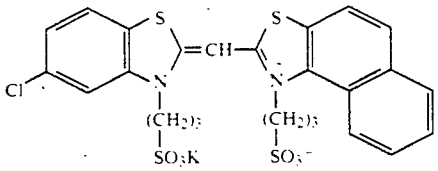

II-6

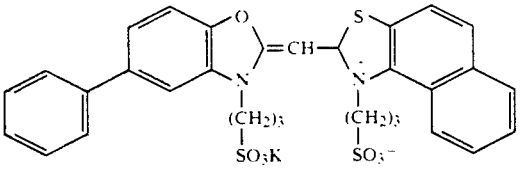

II-7

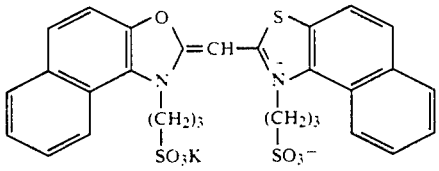

II-8

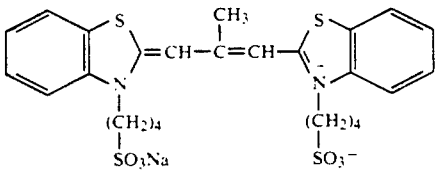

II-9

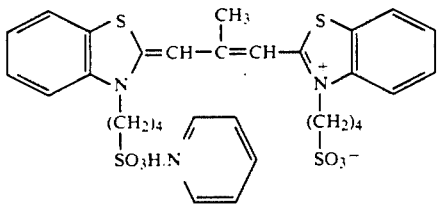

II-10

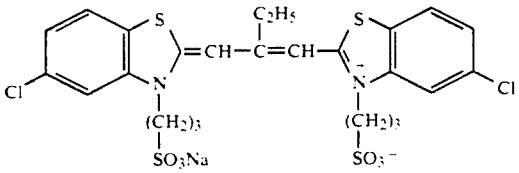

II-11

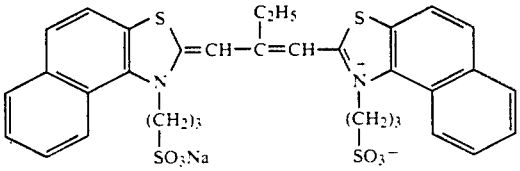

-continued
II-12
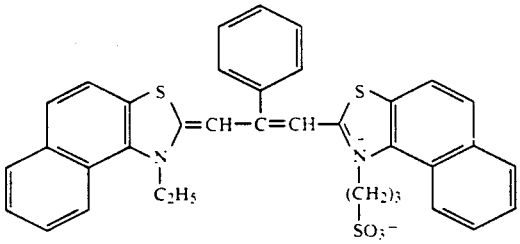
II-13
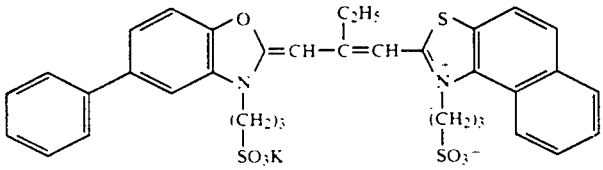
II-14
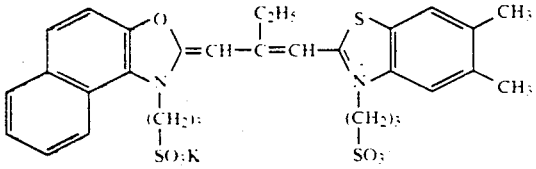
II-15
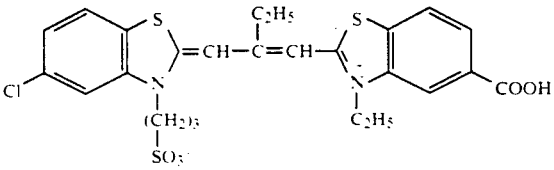
II-16
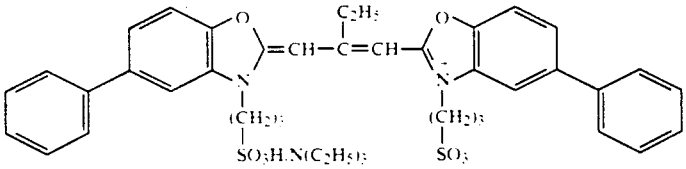
II-17
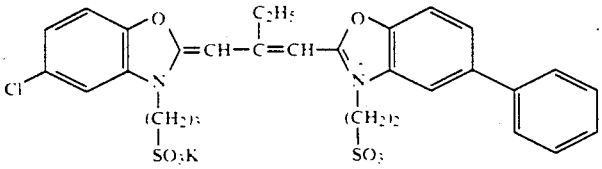
II-18
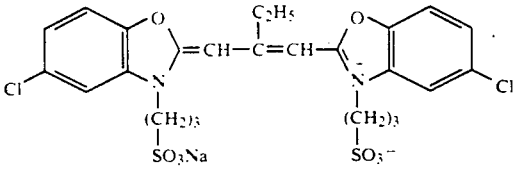
II-19
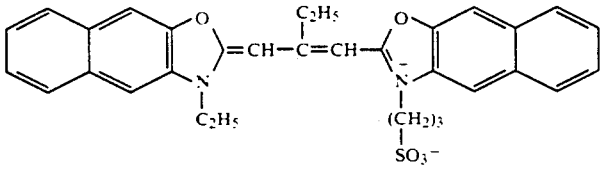
II-20
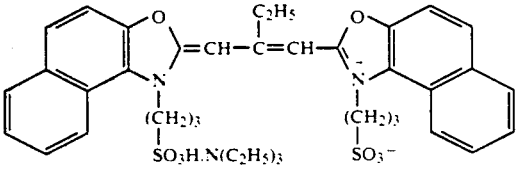
II-21
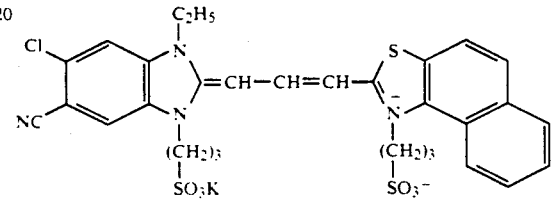

-continued
II-22
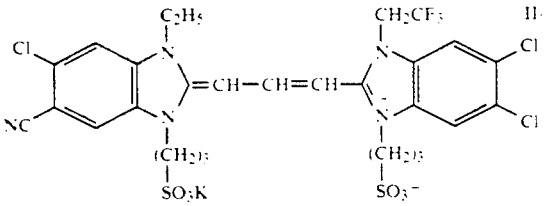
II-23
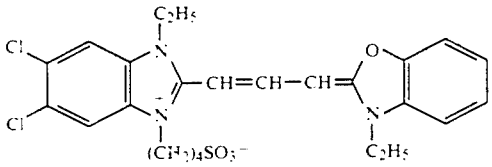
II-24
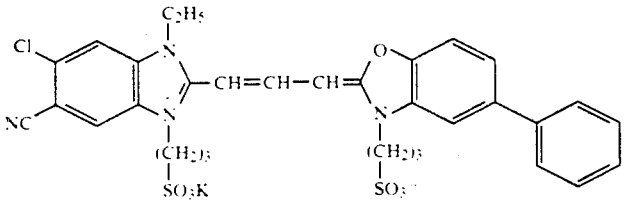
II-25
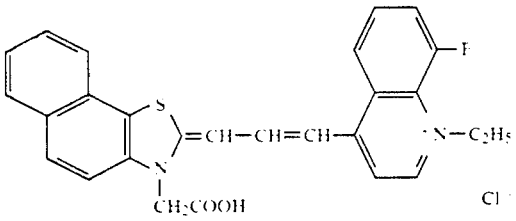
II-26
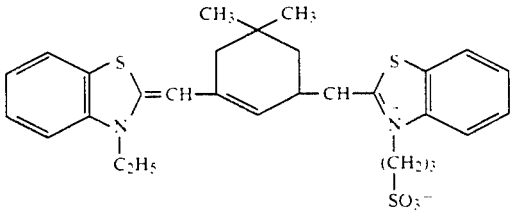
II-27
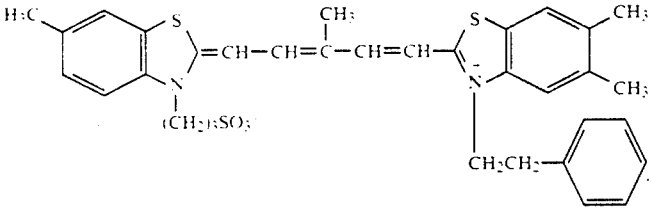
II-28
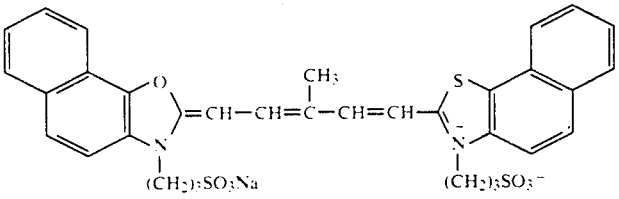
II-29
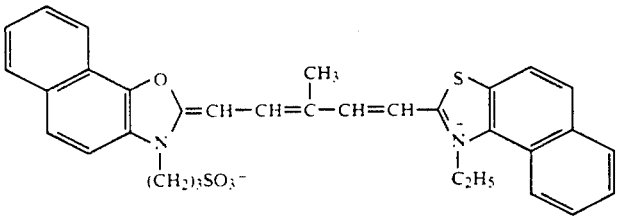
II-30
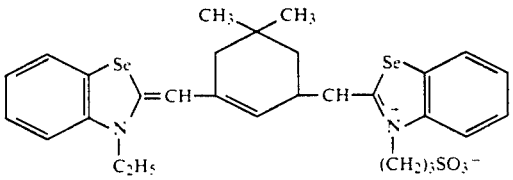

-continued
II-31
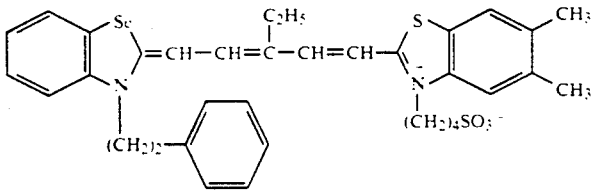
II-32
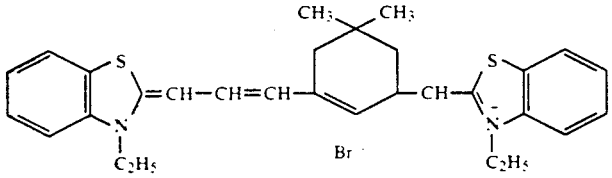
II-33
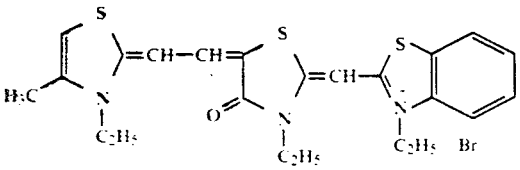
II-34
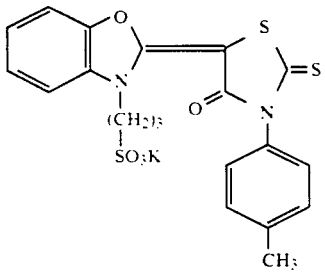
II-35
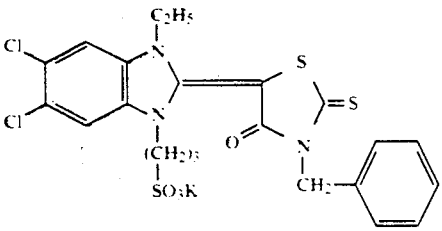
II-36
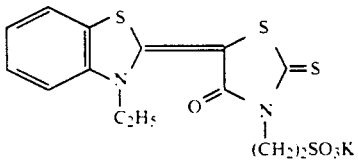
II-37
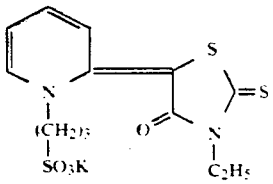
II-38
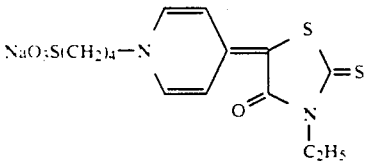
II-39
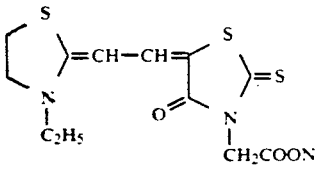
II-40
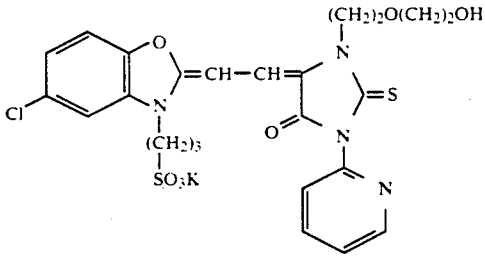
II-41
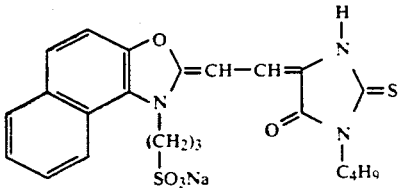
II-42
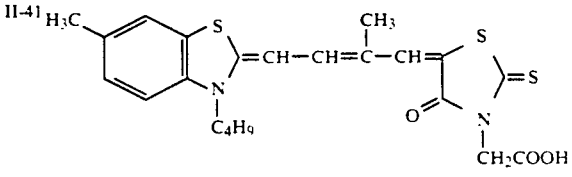

-continued

II-43

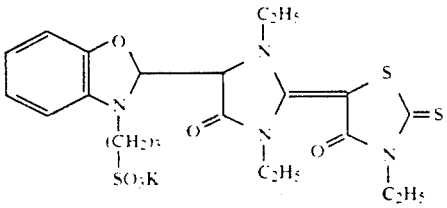

II-44

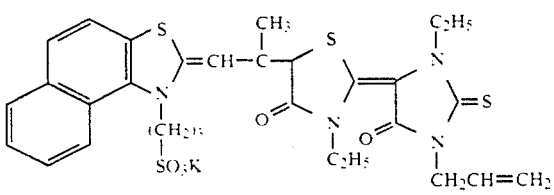

II-45

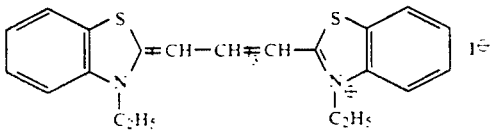

II-46

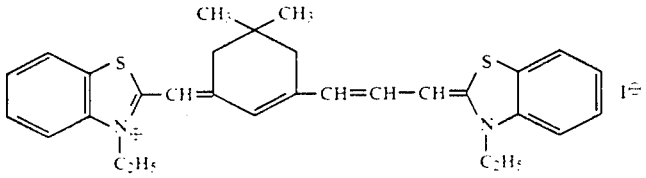

II-47

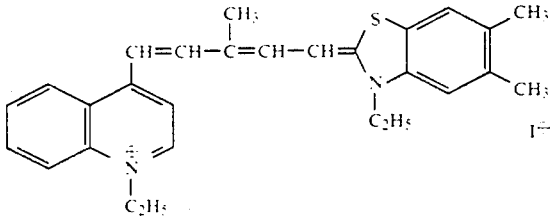

In the above, the cyanine dyes are particularly preferred.

Silver chloride, silver chlorobromide, silver bromide, silver iodobromide and silver chloroiodobromide can be used as the silver halide for the photosensitive tabular silver halide emulsion of the present invention, but silver bromide or silver iodobromide is preferred for high sensitivity, and an iodide content of 0 mol % to 3.5 mol % is particularly preferred.

The project surface area diameter of the tabular emulsions of the present invention is preferably from 0.3 to 2.0 μm, and particularly from 0.5 to 1.2 μm. In addition, the parallel surface distance (grain thickness) is preferably from 0.05 μm to 0.3 μm and particularly preferably from 0.1 to 0.25 μm.

The production method for the tabular silver halide grains may comprise an appropriate combination of methods known in the industry.

Tabular silver halide emulsions are disclosed, for example, at pages 121 to 123 of Vol. 33, No. 2 of "Evolution of the Morphology of Silver Bromide Crystals During Physical Ripening" (Science et Industries Photographique 1962) by Cugnac et Château; at pages 66 to 72 of "Photographic Emulsion Chemistry", Focal Press, New York, (1966) by Duffin and at page 285 of Vol. 80 of the "Photographic Journal" (1940) by A. P. H. Trivelli and W. F. Smith, but the tabular emulsions may be easily prepared also by reference to the methods disclosed in JP-A-58-127921, JP-A-58-113927, JP-A-58-113928 and U.S. Pat. No. 4,439,520.

Furthermore, the tabular emulsions at the present invention may be obtained by forming seed crystals, in which tabular grains are present in an amount of at least 40% by weight, in a relatively low pBr value environment of 1.3 or less, and growing the seed crystals while simultaneously adding silver and a halide solution, while maintaining a pBr value of the same order.

In this crystal forming stage, it is desirable to add the silver salt and halide solutions in such a way that new crystal nuclei are not formed.

The size of the tabular silver halide grains can be adjusted by regulating the temperature, selecting the type and amount of solvent, and controlling the rate of addition of the silver salts and halides used during grain growth.

Furthermore, of the tabular silver halide grains, monodisperse hexagonal tabular grains are particularly useful.

Details concerning the structure and production methods for monodisperse hexagonal tabular grains as referred to above, are disclosed in JP-A-63-151618.

According to the present invention, halide conversion type grains, as disclosed in G.B. Patent 635,841 and U.S. Pat. No. 3,622,318, are particularly effective. The halide conversion amount is from 0.2 to 2 mol %, and particularly 0.2 to 0.4 mol % with respect to the silver amount.

Silver iodobromide grains with a structure having a high-iodide layer inside and/or on the surface are particularly preferred.

Higher sensitive silver halide emulsions are obtained by converting the surfaces of the tabular silver halide grains of the present invention.

The method for halogen conversion normally comprises adding an aqueous halogen solution whose solubility product with silver is even less than that of the halogen composition of the grain surface prior to halogen conversion. For example, conversion is brought about by adding aqueous potassium bromide and/or potassium iodide solutions to tabular silver chloride or silver chlorobromide grains, or by adding an aqueous potassium iodide solution to tabular silver bromide or silver iodobromide grains. Better results are obtained by using more dilute concentrations of the added aqueous solution of 30 wt % or less, and preferably 10 wt % or less. Furthermore, it is preferably to add the halogen conversion solution at a rate of 1 mol % or less per minute per mole of silver halide prior to halogen conversion. Furthermore, a portion or all of the silver halide adsorbing substances and/or sensitizing dyes of the present invention may be introduced during halogen conversion, and fine silver halide grains of silver bromide, silver iodobromide or silver iodide may be added instead of the aqueous halogen conversion solution. The size of these fine grains is 0.2 μm or less, preferably 0.1 μm or less and it is particularly preferably 0.05 μm or less.

The halogen conversion method of the present invention is not limited to the methods described above, and a combination of methods may also be used. An iodine content of 3 mol % or less is preferred for the silver halide composition on the grain surface prior to halogen conversion, and 1.0 mol % or less is particularly preferred.

When carrying out halogen conversion, a method in which a silver halide solvent is introduced is particularly effective. Preferred solvents include thioether compounds, thiocyanates and 4-substituted thioureas. Of these, thioether compounds and thiocyanates are particularly effective, and it is preferable to use the thiocyanates in an amount of from 0.5 to 5 g and the thioethers in an amount of from 0.2 to 3 g per mole of silver halide.

In the present invention, two or more types of silver halide emulsions may be mixed and used for the tabular silver halide emulsion. The grain sizes, halogen compositions, sensitivity and other such aspects of the mixed emulsions may differ. For example, a spherical or potato-shaped photosensitive emulsion and a photosensitive silver halide emulsion composed of tabular grains having a grain diameter 3 or more times the grain thickness may be used in the same layer or, as disclosed in the report of JP-A-58-127921, in different layers. When the differing emulsions used in different layers, the photosensitive silver halide emulsion composed of the tabular grains may be present either nearer side to the support, or conversely further from the support.

During the silver halide production, cadmium salts, zinc salts, lead salts, thallium salts, iridium salts or complex salts thereof, rhodium salts or complex salts thereof, iron salts or complex iron salts may be included together in the silver halide grain formation or physical ripening stage.

In addition, so-called silver halide solvents such as thiocyanates, thioether compounds, thiazolidinethione and 4-substituted thioureas may be present during the grain formation. Of these, thiocyanates, 4-substituted thioureas and thioethers are preferred solvents for use in the present invention.

For chemically sensitizing the silver halide emulsion of the present invention, known methods may be employed such as sulfur sensitization, selenium sensitization, reduction sensitization and gold sensitization in the presence of the abovenoted silver halide adsorbing substances, and these may be used alone or in combination.

Gold sensitization is representative of noble metal sensitization, and complex gold salts are principally used. The present invention is not impaired by the inclusion of complex salts of noble metals other than gold such as platinum., palladium and iridium. Specific examples are disclosed, for example, in U.S. Pat. No. 2,448,060 and G.B. Patent 618,061.

Sulfur sensitizers for use in the present invention include various sulfur compounds such as thiosulfates, thioureas, thiazoles and rhodanines in addition to the sulfur compounds contained in gelatin. Specific examples are disclosed in U.S. Pat. Nos. 1,574,944, 2,278,947, 2,410,689, 2,728,668, 3,501,313 and 3,656,955.

The advantages of the present invention are effectively obtained by the conjoint use of gold sensitization and sulfur sensitization using thiosulfates.

For the reduction sensitization, it is possible to use stannous salts, amines, formamidinesulfinic acid and silane compounds.

The photosensitive silver halide emulsion of the present invention is spectrally sensitized to comparatively longer wavelength blue light, green light, red light or infrared light using sensitizing dyes. Sensitizing dyes are use as silver halide adsorbing substances in the chemical sensitization stage, but spectrally sensitizing dyes for other wavelength regions may be added as required.

Various surfactants may be included in the photographic emulsion layers or other hydrophilic colloid layers of the present invention for various purposes such as auxiliary coating, static prevention, improving slip properties, emulsification and dispersion, adhesion prevention and improving photographic characteristics (for example, developability, film hardening, increased sensitivity).

For example, non-ionic surfactants such as saponin (steroid-based), alkylene oxide derivatives (for example, polyethylene glycol, polyethylene glycol/polypropylene glycol condensates, polyethylene glycol alkyl ethers or polyethylene glycol alkyl aryl ethers and polyethylene oxide adducts of silicones) and alkyl esters of sugars; anionic surfactants such as alkylsulfonates, alkylbenzenesulfonates, alkylnaphthalenesulfonates, alkylsulfate esters, N-acyl-N-alkyltaurines, sulfosuccinic acid esters and sulfoalkylpolyoxyethylene alkylphenyl ethers; amphoteric surfactants such as alkylbetains and alkylsulfobetains; and cationic surfactants such as aliphatic or aromatic quaternary ammonium salts, pyridinium salts and imidazolium salts may be used.

Of these, particularly preferred surfactants include saponin, anionic surfactants such as sodium dodecylbenzenesulfonate, sodium di-2-ethylhexyl-α-sulfosuccinate, sodium p-octylphenoxyethoxyethanesulfonate, sodium dodecylsulfate, sodium triisopropylnaphthalenesulfonate and sodium N-methyloleyltaurine, cationic surfactants such as dodecyltrimethylammonium chloride, N-oleyl-N',N',N'-trimethylammoniodiaminopropane bromide and dodecylpyridinium chloride, and nonionic surfactants such as N-dodecyl-N,N-dimethylcarboxybetain, N-oleyl-N,N-dimethylsulfobutylbetain and other such betains, poly(average degree of polymerization n=10)-oxyethylenecetyl ether, poly(n=25)oxyethylene-p-nonylphenol ether, bis(1-poly(n=15)oxyethyleneoxy-2,4-di-t-pentylphenyl)ethane.

Preferred antistatic agents for use in the present invention include potassium perfluorooctane sulfonate, sodium N-propyl-N-perfluorooctanesulfonyl glycerine, sodium N-propyl-N-perfluorooctanesulfonylaminoethyloxypoly(n=3)oxyethylenebutane sulfonate, N-perfluorooctanesulfonyl-N' ,N',N'-trimethylammoniodiaminopropane chloride, N-perfluorodecanoylaminopropyl-N',N'-dimethyl-N'-carboxybetain and other such fluorine-containing surfactants, the nonionic surfactants disclosed, for example, in JP-A-60-80848, JP-A-61-112144, JP-A-62-172343 and JP-A-62-173459, alkali-metal nitrates, electrically conductive tin oxide, zinc oxide, vanadium pentoxide or complex oxides in which these have been doped with antimony or the like.

Matting agents for use in the present invention include fine particles of inorganic compounds such as silica, titanium dioxide, sulfuric acid, strontium and barium or organic compounds such as starch, homopolymers of polymethyl methacrylate or copolymers of methyl methacrylate and methacrylic acid as disclosed in U.S. Pat. Nos. 2,992,101, 2,701,245, 4,142,894 and 4,396,706.

The particle size is preferably from 1.0 to 10 μm, and 2 to 5 μm is particularly preferred.

In the surface layers of photographic materials of the present invention, the silicon compounds disclosed, for example, in U.S. Pat. Nos. 3,489,576 and 4,047,958, the colloidal silica disclosed in JP-B-56-23139 as well as paraffin wax, higher aliphatic esters and starch derivatives as slip agents may be used.

In the hydrophilic colloid layers of the photographic material of the present invention, trimethylol propane, pentanediol, butanediol, ethylene glycol, glycerine and other such polyols as plasticizers can be used.

Gelatin is beneficially used as the binder of protective colloids in the emulsion layers, intermediate layers and surface protective layers of the photosensitive material of the present invention, but other hydrophilic colloids may also be used.

For example, a variety of synthetic hydrophilic macromolecular substances may be used as the binder material such as gelatin derivatives, graft polymers of gelatin and other polymers, albumin, casein and other such proteins; hydroxyethyl cellulose, carboxymethyl cellulose, cellulose sulfate esters and other such cellulose derivatives, sodium alginate, dextran, starch derivatives and other such carbohydrate derivatives; polyvinyl alcohol, polyvinyl alcohol part acetal, poly-N-vinylpyrrolidone, polyacrylic acid, polymethacryic acid, polyacrylamide, polyvinyl imidazole, polyvinylpyrazole and other such monomers and copolymers.

In addition to lime-treated gelatin, acid-treated gelatin and enzyme-treated gelatin may also be used as the gelatin, or alternatively, the hydrolysis products or enzymolysis products of gelatin may also be used.

Of these, it is preferable to use a polyacrylamide or dextran having an average molecular weight of 100,000 or less in conjunction with the gelatin. The methods disclosed in JP-A-63-68837 and JP-A-63-149641 are also effective in the present invention.

Inorganic or organic film hardeners may be included in the photographic emulsions and nonphotosensitive hydrophilic colloids of the present invention. For example, it is possible to use, either singly or in combination, chromium salts (for example, chromium alum, chromium acetate), aldehydes (for example, formaldehyde, glyoxal, glutarlaldehyde), N-methylol compounds (for example, dimethylol urea, methylol dimethylhydantoin), dioxane derivatives (for example, 2,3-dihydroxydioxane), active vinyl compounds (for example, 1,3,5-triacryloylhexahydro-s-triazine, bis(vinylsulfonyl)-methylether, N,N'-methylenebis-[β-(vinylsulfonyl)-propionamide]), active halogen compounds (for example, 2,4-dichloro-6-hydroxy-s-triazine), mucohalogenic acids (for example, mucochloric acid, mucophenoxychloric acid), isooxazoles, dialdehyde starch, 2-chloro-6-hydroxytriazinylated gelatin and the like. Of these, the active vinyl compounds disclosed in JP-A-53-41221, JP-A- 53-57257, JP-A-59-162546 and JP-A-60-80846, and the active halogen compounds disclosed in U.S. Pat. No. 3,325,287 are preferred.

Macromolecular film hardeners can also be used effectively as film hardeners of the present invention.

Macromolecular film hardeners for use in the present invention include, for example, dialdehyde starch, polyacrolein, polymers having aldehyde groups such as the acrolein copolymers disclosed in U.S. Pat. No. 3,396,029, polymers having epoxy groups as disclosed in U.S. Pat. No. 3,628,878, polymers having dichlorotriazine groups as disclosed, for example, in U.S. Pat. No. 3,362,827 and Research Disclosure Journal No. 17333 (1978), polymers having active ester groups as disclosed in JP-A-56-66841, and polymers having active vinyl groups or groups constituting precursors thereof as disclosed, for example, in JP-A-56-142524, U.S. Pat. No. 4,161,407, JP-A-54-65033 and Research Disclosure Journal No. 16725 (1978); polymers having active vinyl groups or groups constituting precursors thereof being preferred, and, of these, the polymers disclosed in JP-A-56-142524 having an active vinyl group or group constituting a precursor thereof joined to the main polymer chain by a long spacer are particularly preferred.

It is preferable that the hydrophilic colloid layers in the photographic materials of the present invention are hardened by the above described film hardeners such that the swelling rate in water is 300% or less, and in particular 230% or less.

Polyethyleneterephthalate films and cellulose triacetate films are preferred for the support of the present invention.

In order to improve the adhesive power of the support with the hydrophilic colloid layer, methods in which its surface is treated by corona discharge, glow discharge, or ultraviolet irradiation are preferred. Alternatively, the support may be provided with an undercoating layer composed of a styrene/butadiene-based latex, a vinylidene chloride-based latex or the like, and may have a gelatin layer provided on the undercoating layer.

Furthermore, the support may also be provided with an undercoating layer using an organic solvent containing a polyethylene swelling agent and gelatin. The adhesive forces between the above described undercoating layers and the hydrophilic colloid layer may be further improved by effecting a surface treatment.

The photographic emulsion layers or other layers of the silver halide photographic material of the present invention may be colored with dyes in order to absorb light in specific wavelength regions to thereby control the spectral composition of the light irradiated onto the photographic emulsion layers or to prevent halation or irradiation. Layers intended for cross-over cutting may be provided below the emulsion layers in two-sided films such as direct medical X-ray films. Such dyes include, for example, the oxonol dyes having pyrazolone nuclei and barbituric acid nuclei as disclosed, for example, in G.B. Patents 506,385, 1,177,429, 1,311,884, 1,338,799, 1,385,371, 1,467,214, 1,433,102 and 1,553,516, JP-A-48-85130, JP-A-49-114420, JP-A-52-117123, JP-A-55-161233, JP-A-59-111640, JP-B-39-22069, JP-B-43-13168 and U.S. Pat. Nos. 3,247,127, 3,469,985 and 4,078,933; other oxonol dyes as disclosed, for example, in U.S. Pat. Nos. 2,533,472 and 3,379,533 and G.B. Patent 1,278,621; the azo dyes disclosed, for example, in G.B. Patents 575,691, 680,631, 599,623, 786,907, 907,125 and 1,045,609, U.S. Pat. No. 4,255,326 and JP-A-59-211043; the azomethine dyes disclosed, for example, in JP-A-50-100116, JP-A-54-118247, G.B. Patents 2,014,598 and 750,031; the anthraquinone dyes disclosed in U.S. Pat. No. 2,865,752; the arydene dyes disclosed, for example, in U.S. Pat. Nos. 2,538,009, 2,688,541 and 2,538,008, G.B. Patents 584,609 and 1,210,252, JP-A-50-40625, JP-A-51-3623, JP-A-51-10927, JP-A- 54-118247, JP-B-48-3286 and JP-B-59-37303; the styryl dyes disclosed, for example, in JP-B-28-3082, JP-B-44-16594 and JP-B-59-28898; the triarylmethane dyes disclosed, for example, in G.B. Patents 446,583 and 1,335,422 and JP-A-59-228250; the merocyanine dyes disclosed, for example, in G.B. Patents 1,075,653, 1,153,341, 1,284,730, 1,475,228 and 1,542,807; and the cyanine dyes disclosed, for example, in U.S. Pat. Nos. 2,843,486 and 3,294,539.

When using such dyes, it is useful to mordant an anionic dye in a specific layer in the photosensitive material using a polymer having cationic sites. In such cases, it is preferable to use a dye which is irreversibly decolored in the developing/fixing/washing stage. The layer in which the dye is mordanted using a polymer having cationic sites may be an emulsion layer, surface protective layer or in a layer on the side of the support opposite to the emulsion layers, but the mordanting layer is preferably between the emulsion layers and the support. In particular, and with respect to cross-over cutting in medical X-ray two-sided films, mordanting is ideally carried out in an undercoating layer. It is preferable to use a polyethylene oxide-based nonionic surfactant in conjunction with the polymer having cationic sites as an auxiliary coating agent in the undercoating layer.

Anion exchange polymers are preferred as polymers which provide cation sites.

Various known quaternary ammonium salt (or phosphonium salt) polymers can be used as the anion exchange polymer. Quaternary ammonium salt (or phosphonium salt) polymers are widely known as mordant polymers and antistatic polymers from, inter alia, the following publications.

For example, the water dispersed latexes disclosed in JP-A-59-166940, U.S. Pat. No. 3,958,995, JP-A-55-142339, JP-A-54-126027, JP-A-54-155835, JP-A-53-30328 and JP-A-54-92274; the polyvinyl pyridinium salts disclosed in U.S. Pat. Nos. 2,548,564, 3,148,061 and 3,756,814; the water-soluble quaternary ammonium salt polymers disclosed in U.S. Pat. No. 3,709,690; and the water-insoluble quaternary ammonium salt polymers disclosed in U.S. Pat. No. 3,898,088 may be used as the mordant polymers.

However, it is preferable to use the methods disclosed in Japanese Patent Applications No. 62-324575, No. 63-026978 and No. 63-139901 such that photographically undesirable effects of migration of the dyes from the desired layer into other layers or into the processing solution is prevented.

Plasticizers for polymers and emulsions and the like may be added in order to improve the pressure characteristics in the emulsion layers of the photographic material of this invention.

For example, the methods using heterocyclic compounds in G.B. Patent 738,618, alkyl phthalates in G.B. Patent 738,637, alkyl esters in G.B. Patent 738,639, polyhydric alcohols in U.S. Pat. No. 2,960,404, carboxyalkylcellulose in U.S. Pat. No. 3,121,060, paraffin and carboxylic acid salts in JP-A-49-5017, and alkyl acrylates and organic acids in JP-B-53-28086 may be used.

Color-forming couplers may also be added to the photographic emulsion layers of the photographic material of the present invention. Useful compounds which form colors by oxidative coupling with primary aromatic amine developing agents (for example, phenylene diamine derivatives and aminophenol derivatives) in the color developing process include magenta couplers such as 5-pyrazolone couplers, pyrazolobenzimidazole couplers, cyanoacetylcoumarone couplers, open-chain acylacetonitrile couplers and the like, yellow couplers such as acylacetamide couplers (for example, benzoyl acetoanilides, pivaloyl acetoanilides) and the like, and cyan couplers such as naphthol couplers and phenol couplers. The non-diffusing couplers having hydrophobic ballast groups are preferred. The couplers may be either of the 4-equivalent or 2-equivalent type with respect to conversion of silver ion. Furthermore, the color-forming couplers may be colored couplers having a color compensating effect, or DIR couplers which release development inhibitors.

Furthermore, in addition to color-forming DIR couplers, colorless DIR coupling compounds wherein the coupling reaction product is colorless and which release development inhibitors may also be incorporated into the material of the present invention.

There are no particular limitations on the structure of the emulsion layers and other layers of the silver halide photographic material of the present invention. The binders, surfactants, dyes, ultraviolet absorbers, film hardeners, auxiliary coating agents, viscosity enhancers and the like disclosed in Research Disclosure Vol. 176, pp. 22–28 (December 1978) may be incorporated into the material of the present invention.

For the photographic processing of the photosensitive materials of this invention, the methods and processing solutions disclosed in Research Disclosure No. 176, pp. 28–30 (RD-17643) may be applied. The photographic processing may be either photographic processing for forming a silver image (black-and-white processing) or photographic processing for forming a color image (color processing). The processing temperature is normally selected between 18° C. and 50° C., but the region between 25° C. and 38° C. is preferred.

The developing solutions used for black-and-white processing of the material of the present invention can contain known developing agents including either individually or in combination, hydroxybenzenes (for example, hydroquinone), 3-pyrazolidones (for example, 1-phenyl-3-pyrazolidone), aminophenols (for example, N-methyl-p-aminophenol) and the like. Apart from these, the developing solutions may generally contain known preservatives, alkalis, pH buffers, antifoggants and the like, and furthermore may contain, as required, auxiliary solvents, color toners, development accelerators (for example, quaternary salts, hydrazines, benzyl alcohol), surfactants, antifoaming agents, water softeners, film hardeners (for example, glutaraldehyde), and viscosity-imparting agents.

A special form of development processing may be used in which the photosensitive material of the present invention is processed in an aqueous alkali solution wherein the developing agent is contained in the photosensitive material, for example, in the emulsion layers. Hydrophobic developing agents can be included in the emulsion layers of the material of the present invention by various methods as disclosed, for example, in Research Disclosure No. 169 (RD-16928), U.S. Pat. No. 2,739,890, G.B. Patent 813,253 or West German Patent 1,547,763.

Generally used compositions may be used as the fixing solution for processing the material of the present invention. As the fixing agents, in addition to thiosulfates and thiocyanates, organic sulfur compounds known as effective fixing agents may be used. Water-soluble aluminium salts may be included in the fixing solution as film hardeners.

The invention is further described in detail with reference to the non-limiting Examples below. Unless otherwise indicated, all compositions are given on a weight percent basis.

Example 1

Preparation of the Support

A corona discharge treatment was carried out on a polyethyleneterephthalate film having a thickness of 175 μm, and which had been biaxially stretched and dyed blue. Coating was carried out with a wire bar coater such that a first undercoating solution with the composition shown below was coated in an amount of 5.1 cc/m² followed by drying at 175° C. for 1 minute. Next, a first undercoating layer was also provided on the opposite surface of the support in the same way.

| | |
|---|---|
| Butadiene/styrene copolymer latex solution* (solid fraction 40%, butadiene/styrene weight ratio = 31/69) | 79 cc |
| Sodium 2,4-dichloro-6-hydroxy-s-triazine, 4% solution | 20.5 cc |
| Distilled water | 900.5 cc |

*The latex solution contained 0.4 wt % of

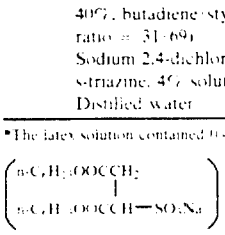

with respect to the solid latex fraction as an emulsifier.

The undercoated film was finally prepared by simultaneously coating a second undercoating solution with the composition shown below onto the first undercoated layers on both sides, followed by drying.

| | |
|---|---|
| Gelatin | 10 g |
| Polymer latex | 4.73 g |

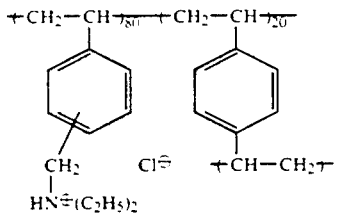

| | |
|---|---|
| Polymethyl methacrylate having an average particle size of 2.5 μm | 0.3 g |
| | 0.035 g |

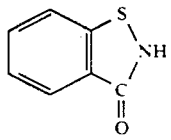

-continued

| | |
|---|---|
| $+CH_2CH+$ (COOH) (average molecular weight 41,000) | 1.0 g |
| Dye | 1.85 g |

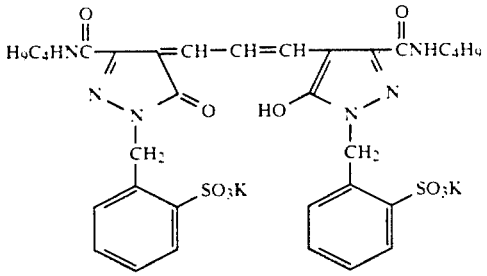

| | |
|---|---|
| $C_{12}H_{25}O(CH_2CH_2O)_{10}H$ | 1 g |
| $H_2O$ added to make up a total of | 1 l |

Preparation of the Surface Protective Layer

A surface protective layer was prepared with the following composition.

| | |
|---|---|
| (coated simultaneously with the emulsion layer to a coated amount of 13.7 cc/m².) | |
| Gelatin | 83 g |
| Polymethyl methacrylate having an average particle size of 3.5 μm | 3.7 g |
| | 1.65 g |

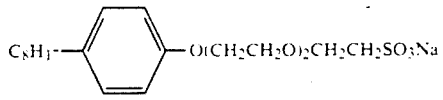

| | |
|---|---|
| $C_8F_{17}SO_2N(C_3H_7)(CH_2CH_2O)_4(CH_2)_4SO_3Na$ | 0.07 g |
| $C_8F_{17}SO_2N(C_3H_7)(CH_2CH_2O)_{15}H$ | 0.37 g |
| $C_{16}H_{33}O(CH_2CH_2O)_{10}H$ | 1.46 g |
| | 0.73 g |

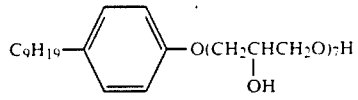

| | |
|---|---|
| $+CH_2CH+$ (COOH) Average molecular weight 41,000 | 1.71 g |
| Polyacrylamide average molecular weight 45,000 | 16.7 g |
| | 0.02 g |

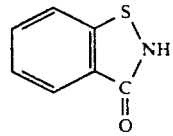

| | |
|---|---|
| | 2 g |

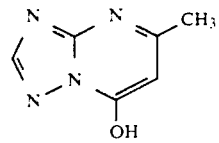

-continued (Adjusted to pH 6.85 with $H_2O$ and NaOH to a total of 1 l)

Emulsion Preparation Prior to Chemical Sensitization

Using the double jet method, an aqueous solution of 8.33 g of silver sulfate and an aqueous solution containing 5.94 g of potassium bromide and 0.726 g of potassium iodide were added over 45 seconds, with stirring, to a solution maintained at 75° C. in which 2.5 cc of a 5% aqueous solution of the thioether $HO(CH_2)_2S(CH_2)_2S(CH_2)_2OH$, 5 g of potasium bromide, 0.05 g of potassium iodide and 35 g of gelatin had been added to 1 l of water. Following the halide addition, 2.5 g of potassium bromide was added and then an aqueous solution containing 8.33 g of silver nitrate was added over 7 minutes and 30 seconds in such a way that the flow rate at the end of the addition was twice that at the start of addition. The controlled double jet method was then used to add an aqueous solution of 153.34 g of silver nitrate and an aqueous solution of potassium bromide and potassium iodide over 25 minutes while maintaining the electrical potential at pAg 8.0. This time the flow rate was increased in such a way that the flow rate at the end of the addition was 8 times that at the beginning of the addition. The potassium iodide consumption at this time was 0.4 mol % of the total silver nitrate addition amount. After the end of the addition, a 15 cc solution of 2N potassium thiocyanate was added and a 50 cc, 1% aqueous potassium iodide solution was also added over 30 seconds. After this, the soluble salts were removed by precipitation by lowering the temperature to 35° C. Then the temperature was raised to 40° C. and 68 g of gelatin and 2 g of phenol were added and the pH was adjusted to 6.50 and the pAg to 8.20 using caustic soda and potassium bromide. The emulsion obtained was composed of grains having an aspect ratio of 3 or more accounting for 93% of the total of the projected surface areas of all the grains; for all the grains with an aspect ratio of 3 or more, the average projected surface area diameter was 1.10 μm, the standard deviation was 18.5% and the average thickness was 0.175 μm, the aspect ratio being 6.29.

Furthermore, the average AgI content of the thus prepared emulsion was 1.2 mol %, and the individual grains were of uniform composition.

Preparation of Comparative Emulsion A

The temperature of the above described emulsion in which chemical sensitization had not been carried out was raised to 56° C. and then 4.8 mg of sodium thiosulfate pentahydrate, 160 mg of potassium thiocyanate and 4.5 mg of chloroauric acid were added for every 1 mole of Ag. Ripening was carried out until the fogging due to the silver halide alone as determined in a coated sample processed according to processing (I) described below reached 0.02. At the moment when the coated sample fogging reached 0.02, 1.12 mmol/1 mol Ag of the sensitizing dye II-18 was added, the pAg was adjusted to 8.5 with potassium bromide, and the temperature was reduced to 35° C.

Preparation of Comparative Emulsion B

The temperature of the above described emulsion in which the chemical sensitization had not been carried out was raised to 56° C., and then 1.42 mmol of a stabilizer with the structural formula I-1 was added per 1 mole of Ag. After 10 minutes, 4.8 mg of sodium thiosulfate pentahydrate, 160 mg of potassium thiocyanate and 4.5 mg of chloroauric acid were added. Ripening was carried out until the fogging due to the silver halide alone as determined in the following coating sample processing (I) reached 0.02. At the moment when the coating sample fogging reached 0.02, 1.12 mmol/1 mol Ag of the sensitizing dye II-18 was added, the pAg was adjusted to 8.5 using potassium bromide and the temperature reduced to 35° C.

Preparation of Comparative Emulsion C

The temperature of the above described emulsion in which the abovementioned chemical sensitization had not been carried out was raised to 56° C., and then 1.12 mmol of the sensitizing dye II-18 was added per mole of Ag. After 10 minutes, 4.8 mg of sodium thiosulfate pentahydrate, 160 mg of potassium thiocyanate and 4.5 mg of chloroauric acid were added and ripening was carried out until the fogging due to the silver halide alone as determined in a coated sample processed according to processing (I) described below reached 0.02. At the moment when the coated sample fogging reached 0.02, the pAg was adjusted to 8.5 using potassium bromide and the temperature was reduced to 35° C.

Preparation of Comparative Emulsion D

Emulsion D was prepared in the same way as C, except that the amount of sensitizing dye II-18 added to emulsion C was changed to 0.95 mmol.

Preparation of Emulsions E-N of This Invention

The emulsions E-N were prepared from the above described base emulsion in which the chemical sensitization had not been carried out.

The temperature of the above described emulsion in which the chemical sensitization had not been carried out was raised to 56° C., and then the stabilizer I-1 was added. After 10 minutes, the stabilizer II-18 was added. The amounts of I-1 and II-18 added to obtain the emulsion E-N are shown in Table 1. After an additional 10 minutes, 4.8 mg of sodium thiosulfate pentahydrate, 160 mg of potassium thiocyanate and 4.5 mg of chloroauric acid were added. Ripening was carried out until the various fogging values due to the silver halide alone as determined in a coated sample processed according to processing (I) described below reached 0.02. At the moment when the respective coated solution fogging values reached 0.02, the pAg was adjusted to 8.5 using potassium bromide and the temperature was reduced to 35° C.

Preparation of Coating Samples 1-14

Emulsion layer coating solutions were prepared by adding the following chemicals to the emulsion A-N which had been prepared using as described above. The added amounts are shown as a proportion with respect to 1 mole of Ag.

| | |
|---|---|
| Potassium bromide | 75 mg |

-continued

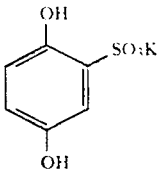

10 g

Polyacrylamide 29 g
average molecular weight 45,000
2,6-bis(hydroxyamino)-4-diethylamino-1,3,5-triazine 93 mg

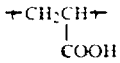

2.7 g

Sodium polystyrenesulfonate 1.7 g
Oil dispersion of a dye with the following structure 19 mg as the dye itself

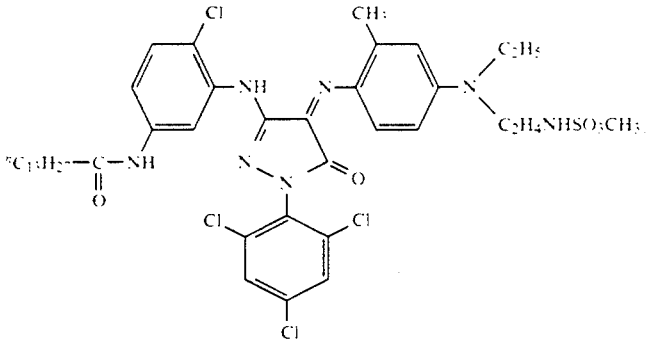

Surfactant dispersion of the dye with the following structure 572 g as the dye itself

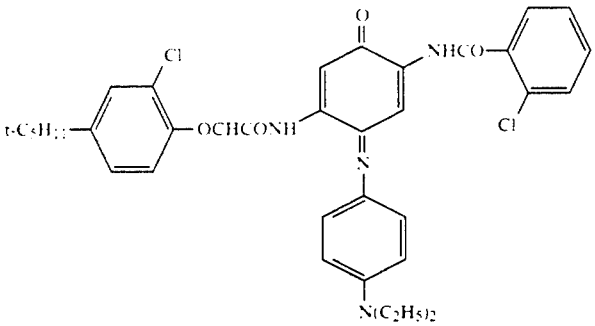

Ethyl acrylate/acrylic acid: 95/5 copolymer 25 g
1,2-bis(sulfonylacetamido)ethane 3.5 g The coating solutions of emulsions A-N obtained as above and surface protective layer solutions were simultaneously coated onto both surfaces of the above-mentioned support using an extrusion method. The coating solutions of one side had dried, followed by coating on the other side without a break and without any winding.

Emulsion layers and surface protective layers were thus coated and dried onto both sides of the support and the winding of the support was carried out afterward.

The amount of Ag coated in the emulsion layers was set at 1.65 g/m$^2$ per side. The samples completed by the coating of emulsions A-N are referred to as samples 1-14 respectively. The following evaluations were carried out after aging the coated samples 1-14 for 7 days at 25° C., and 65% RH.

Evaluation of Photographic Performance

Samples 1-14 were subjected to a 1/10 second exposure using green light having a peak at 540-550 nm and then processing including the development/fixing/washing/drying steps of processing (I) or processing (II) was carried out using an automatic developing machine. The sensitivity is represented as the reciprocal of an exposure giving a density of fog+1.0, and the gradation is the gradient of a straight line joining the density points fog+0.25 and fog+2.0 when the exposure is on the abscissa on a logarithmic scale.

The details of processing (I) and processing (II) shown in Table 2.

TABLE 2

| | Processing (I) | Processing (II) |
|---|---|---|
| Development | Developing solution (I) 35° C., 25 sec. | Developing solution (II) 35° C., 12.5 sec. |
| Fixing | Fixing solution (I) 30° C., 20 sec. | Fixing solution (I) 30° C., 10 sec. |
| Water washing | 15° C., 15 sec. | 15° C., 7.5 sec. |
| Drying | 40° C. | 50° C. |
| Dry-to-dry processing time | 90 sec. | 48 sec. |

| | |
|---|---|
| Developing solution (I) | |
| 1-Phenyl-3-pyrazolidone | 1.5 g |
| Hydroquinone | 30 g |
| 5-Nitroindazole | 0.25 g |
| Potassium bromide | 3.0 g |
| Anhydrous sodium sulfite | 50 g |
| Potassium hydroxide | 30 g |
| Boric acid | 10 g |
| Glutaraldehyde | 5 g |
| Water added to a total of 1 l (pH adjusted to 10.20) | |
| Fixing solution (I) | |
| Ammonium thiosulfate (70 wt/vol %) | 200 ml |
| Sodium ethylenediaminetetraacetate, dihydrate | 0.02 g |
| Sodium sulfite | 15 g |
| Boric acid | 10 g |
| Sodium hydroxide | 6.7 g |
| Glacial acetic acid | 15 g |
| Aluminum sulfate | 10 g |
| Sulfuric acid (36 N) | 3.9 g |
| Water added to a total of 1 l (pH adjusted to 4.25) | |
| Developing solution (II) | |
| Potassium hydroxide | 29 g |
| Potassium sulfite | 44.2 g |
| Sodium hydrogen carbonate | 7.5 g |
| Boric acid | 1.0 g |
| Diethylene glycol | 12 g |
| Ethylenediaminetetraacetic acid | 1.7 g |
| 5-Methylbenzotriazole | 0.06 g |
| Hydroquinone | 30 g |
| Glacial acetic acid | 18 g |
| Triethylene glycol | 12 g |
| 5-Nitroindazole | 0.25 g |
| 1-Phenyl-3-pyrazolidone | 2.8 g |
| Glutaraldehyde (50 wt/wt %) | 9.86 g |
| Sodium metabisulfite | 12.6 g |
| Potassium bromide | 3.7 g |
| Water | to 1 l |

The processing results are collected in Table 1.

Residual Color Evaluation

The residual color levels were functionally evaluated by processing unexposed films using the above described processing (II). The criteria for the evaluation were:

A . . . a state in which residual color is hardly detectable,

C . . . a state in which residual color is noticeable, but is hardly objectionable for practical purposes; a tolerable level.

E . . . a state in which residual color is clearly present and is objectionable for practical purposes, B and D are intermediate states of quality between A and C, and C and E, respectively. The results are given in Table 1.

Evaluation of Abrasion

The unexposed samples 1-14 were adjusted for humidity for 2 hours under conditions of 25° C. and 25% RH. A fixed load of 40 g/cm$^2$ was applied to a surface area of 1 cm × 2.5 cm using a commercial nylon brush and the samples 1-14 were rubbed in a linear direction at a speed of 1 cm/sec. After this, the samples were processed using the processing (I) while still in the unexposed state. The number of marking lines from the nylon brush which remained on samples 1-14 after processing was counted.

The results are given in Table 1.

TABLE 1

| | Addition prior to the start of chemical sensitization (mmol/1 mol Ag) | | Addition after chemical sensitization Sensitizing dye II-18 (mmol/1 mol Ag) | Processing (I) | | Processing (II) | | Abrasion blackening (No. of marking lines) | Residual color with processing (II) |
|---|---|---|---|---|---|---|---|---|---|
| | Sensitizing dye II-18 | Stabilizer I-1 | | Sensitivity | Gradation | Sensitivity | Gradation | | |
| Sample 1 (comp.) | — | — | 1.12 | 65 | 2.55 | 55 | 2.3 | 48 | E |
| Sample 2 (comp.) | — | 1.42 | 1.12 | 70 | 2.6 | 60 | 2.5 | 40 | D |
| Sample 3 (comp.) | 1.12 | — | — | 100 | 2.7 | 98 | 2.68 | 65 | E |
| Sample 4 (comp.) | 0.95 | — | — | 88 | 2.65 | 80 | 2.6 | 59 | D |
| Sample 5 (comp.) | 0.4 | 1.42 | — | 52 | 2.8 | 43 | 2.64 | 28 | A |
| Sample 6 (comp.) | 0.95 | 0.4 | — | 90 | 2.7 | 86 | 2.65 | 52 | D |
| Sample 7 (inv.) | 0.95 | 0.71 | — | 95 | 2.75 | 95 | 2.78 | 40 | C |
| Sample 8 (inv.) | 0.95 | 1.42 | — | 100 | 2.75 | 102 | 2.78 | 28 | B |
| Sample 9 (inv.) | 0.95 | 1.80 | — | 95 | 2.75 | 96 | 2.75 | 21 | A |
| Sample 10 (inv.) | 0.84 | 1.80 | — | 90 | 2.8 | 95 | 2.8 | 15 | A |
| Sample 11 (inv.) | 1.50 | 1.42 | — | 95 | 2.75 | 95 | 2.7 | 30 | B |
| Sample 12 (inv.) | 0.84 | 2.20 | — | 85 | 2.85 | 86 | 2.85 | 12 | A |
| Sample 13 (inv.) | 0.84 | 3.0 | — | 80 | 2.85 | 82 | 2.85 | 10 | A |
| Sample 14 (comp.) | 0.84 | 5.5 | — | 43 | 2.9 | 43 | 2.85 | 7 | A |

Comp. = Comparative
Inv. = This invention

As is clear from Table 1, high sensitivity is obtained with the samples of the invention using both the processing (I) and the processing (II), and residual color and abrasion blackening are greatly improved as compared to the comparative samples. The photosensitive material of the present invention is practical and has an excellent overall performance.

In addition, upon observing the development initiation point using the method disclosed in Japanese Patent Application No. 62-141112, it was confirmed that the samples of the present invention have their development initiation point on the apex of the hexagonal tabular grain.

Example 2

Similar results as in Example 1 were also achieved with a combination of the stabilizer I-2 and sensitizing dye II-18.

Example 3

Similar results as in Example 1 were achieved with the stabilizer I-1 and sensitizing dye II-9. However, the advantages of the present invention are most prevalent when the stabilizer I-1 is used in an amount of from 2 to 4 mmol per mole of Ag.

While the invention has been described in detail and with reference to specific embodiments thereof, it will be apparent to one skilled in the art that various changes and modifications can be made therein without departing from the spirit and scope thereof.

What is claimed is:

1. A chemically sensitized silver halide photographic emulsion comprising silver iodobromide grains having an iodide content of not more than 3.5 mol %, at least 70% of the projected surface area of all the silver halide grains being constituted by tabular grains having an aspect ratio of from 3 to 20 and projected surface area diameter of from 0.3 to 2.0 μm, wherein from 0.5 to 1.5 millimoles per mole of the silver halide of a sensitizing dye selected from the group consisting of cyanine dyes, merocyanine dyes, complex cyanine dyes, complex merocyanine dyes, holopolar cyanine dyes, styryl dyes, hemicyanine dyes, oxonol dyes and hemioxonol dyes and 0.5 to 3.0 millimoles per mole of the silver halide of at least one silver halide adsorbing substance other than a sensitizing dye selected from an azaindene compound are introduced after grain formation and prior to the addition of chemical sensitizers to the emulsion and are present during chemical sensitization of the silver halide.

2. A chemically sensitized silver halide photographic emulsion as in claim 1, wherein the silver halide tabular grains have an aspect ratio of from 4 to less than 8.

3. A chemically sensitized silver halide photographic emulsion as in claim 1, wherein the sensitizing dye is a cyanine dye.

* * * * *